US005175912A

United States Patent [19]

Chevalley et al.

[11] Patent Number: 5,175,912

[45] Date of Patent: Jan. 5, 1993

[54] FASTENER FOR A WRISTWATCH STRAP

[76] Inventors: Gianandrea Chevalley, Corso Re Umberto 30, I-10128 Torino, Italy; Enzo De Carlo, Via Pio VII, 91, I-10135 Torino, Italy

[21] Appl. No.: 768,958

[22] PCT Filed: Apr. 17, 1990

[86] PCT No.: PCT/EP90/00600

§ 371 Date: Oct. 21, 1991

§ 102(e) Date: Oct. 21, 1991

[87] PCT Pub. No.: WO90/12519

PCT Pub. Date: Nov. 1, 1990

[30] Foreign Application Priority Data

Apr. 21, 1989 [IT] Italy ..... 53039 B/89

[51] Int. Cl.[5] ..... A44B 11/00; A44B 21/00

[52] U.S. Cl. ..... 24/685; 24/71 J; 24/265 WS

[58] Field of Search ..... 24/68 J, 69 J, 70 J, 24/71 J, 265 WS, 265 B

[56] References Cited

U.S. PATENT DOCUMENTS

| | | | |
|---|---|---|---|
| 1,764,440 | 6/1930 | Gammell et al. . | |
| 1,786,943 | 12/1930 | Gammell | 24/68 J |
| 1,985,835 | 12/1934 | Prestinari | 24/71 J |
| 1,997,723 | 4/1935 | Franklin, Jr. . | |
| 1,997,836 | 4/1935 | Steinberg | 24/68 J |
| 2,097,055 | 10/1937 | Bender | 24/71 J |
| 2,262,623 | 11/1941 | Ritter | 24/71 J |
| 2,282,563 | 5/1942 | Corbi et al. . | |
| 2,461,309 | 2/1949 | Cedar | 24/71 J |

FOREIGN PATENT DOCUMENTS

| | | | |
|---|---|---|---|
| 0641909 | 8/1928 | France | 24/68 J |
| 1483650 | 6/1967 | France . | |

*Primary Examiner*—Victor N. Sakran

*Attorney, Agent, or Firm*—Sughrue, Mion, Zinn, Macpeak & Seas

[57] ABSTRACT

A pair of fasteners for a wristwatch strap having two ends are connected to opposite sides of a watch case, each of which includes an arcuate catch element (3) provided with guide members (5, 28) extending longitudinally of the strap (2) and an end engagement member (11), and a pair of slide elements (16), each of which is provided with a latch member (20, 32) complementary to engagement member (11), are connected to the two ends of the strap. Each slide element (16) is slidable along a guide member (5, 28) between an advanced position, in which the strap (2) is shortest and in which a latch member (20, 32) engages an engagement member (1), and a retracted position, in which the strap (2) is longest.

8 Claims, 5 Drawing Sheets

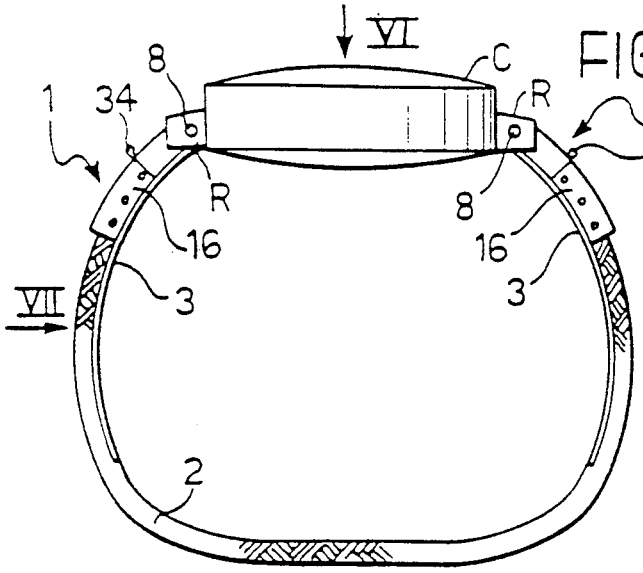
FIG. 5
FIG. 6
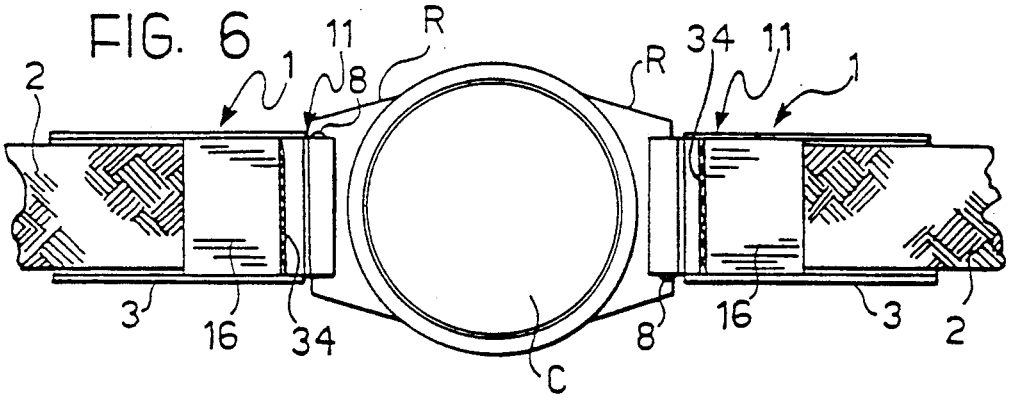
FIG. 7
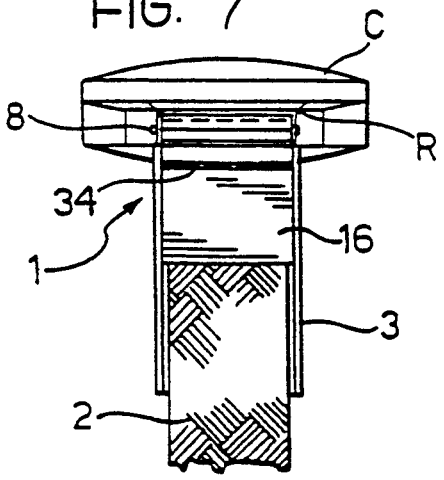

FASTENER FOR A WRISTWATCH STRAP

BACKGROUND OF THE INVENTION

The present invention relates to wristwatch straps and its object is to provide a fastener for such straps which has a simple, functional and versatile conformation as well as being convenient and easy to operate both during fastening of the watch on the user's wrist and during its removal, and when it is wished to remove the strap rapidly in order to replace it.

SUMMARY OF THE INVENTION

According to the invention, this object is achieved by means of a fastener for a wristwatch strap, characterised in that it comprises at least one arcuate catch element provided with guide means extending longitudinally of the strap and an end engagement member, and at least one slide element provided with a latch member complementary to the end engagement member of the catch element, the slide element being slidable along the guide means between an advanced position, in which the strap is shortest and in which the latch member engages the engagement member, and a retracted position, in which the strap is longest; means being provided for releasing the latch member from the engagement member when the- slide element is in the advanced position and for enabling the slide element to be released from the catch element in the retracted position to unfasten the strap.

The invention provides for various embodiments which may have two catch elements fitted to opposite sides of the watch case and which cooperate with two slide elements carried by the ends of the strap, or a single catch element provided on one side of the case and cooperating with a single slide element carried by the corresponding end of the strap, or even a single catch element and a single slide element fitted to a central region of the strap, that is, in a position remote from the case.

In the preferred embodiment of the invention, which has two slide elements fixed to the ends of the strap and which cooperate with two catch elements articulated to the watch case, each catch element comprises a base projecting from the end engagement member and provided with raised side walls with free guide edges bent inwardly of the base and each slide element has two side appendages engaged for sliding along the guide edges of the respective catch element.

According to this embodiment, the end engagement member is constituted by a transverse tab situated above the base and the latch member is constituted by a complementary recess formed in a resilient front appendage of the slide element which is resiliently deformable by means of a push member. Moreover, at its opposite end from the end engagement member, the base of the catch element has a projection for frictional interference with the back of the strap when the slide element is in the retracted position.

According to this embodiment, in practice, the two catch elements are articulated permanently to the watch case, that is, they need not be removed during the normal lengthening and shortening of the strap which is necessary for the watch to be fastened on the user's wrist and for it to be removed. In fact, for these operations, it suffices to release and move one or both of the slide elements. Any replacement of the strap can then be achieved by the user himself, without the need for any tools, by means of a pull on both of the slide elements, which have first been placed in the retracted positions, so as to overcome the frictional resistance of the projections provided on the two guide bases of the, catch elements.

BRIEF DESCRIPTION OF THE DRAWINGS

The invention will now be described in detail with reference to the appended drawings, provided purely by way of non-limiting example, in which:

FIG. 5 shows a second variant of FIG. 1, FIG. 6 is a flattened plan view taken on the arrow VI of FIG. 5, FIG. 7 is an elevational..view taken on the arrow VII of FIG. 5.

DETAILED DESCRIPTION OF THE INVENTION

Figure 1:
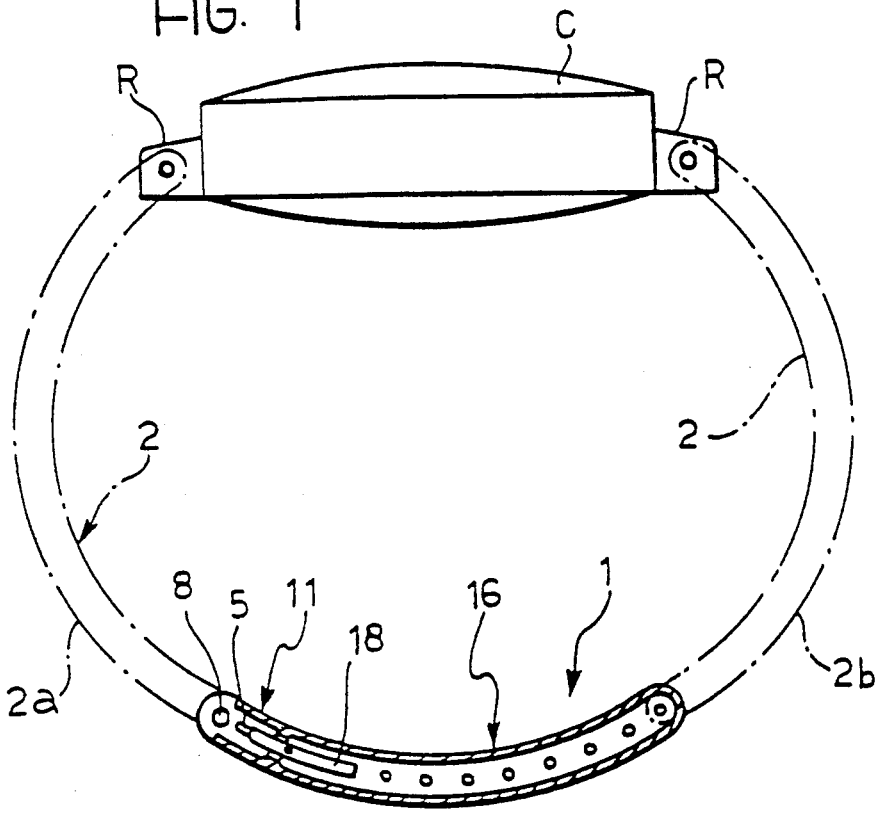
FIG. 1 is a partially-sectioned, schematic, side-elevational view of a wristwatch with a strap provided with a fastener according to a first embodiment of the invention.
Figure 3:
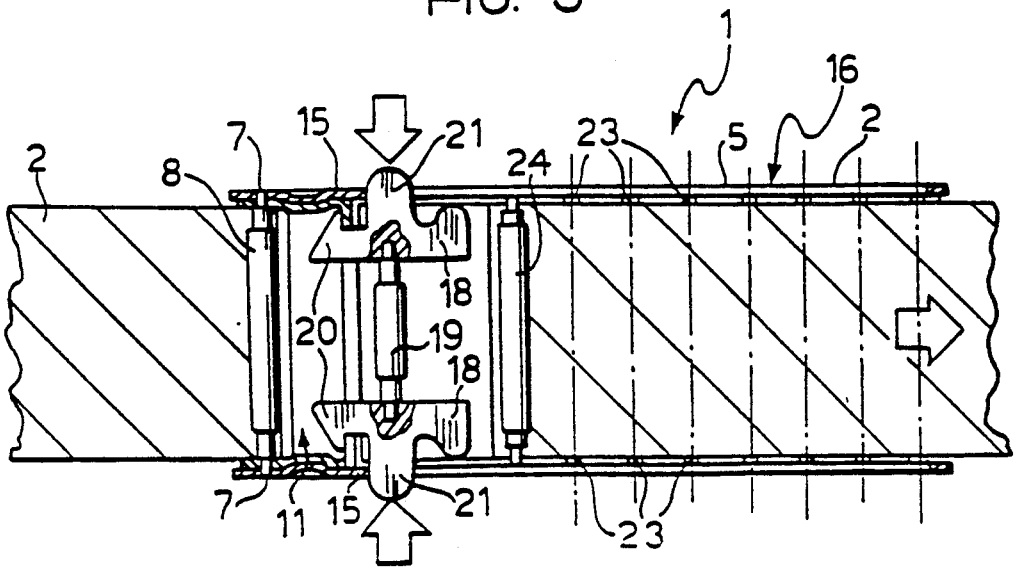
FIG. 3 is a longitudinal section of the fastener of FIGS. 1 and 2 on an enlarged scale.
Figure 9:
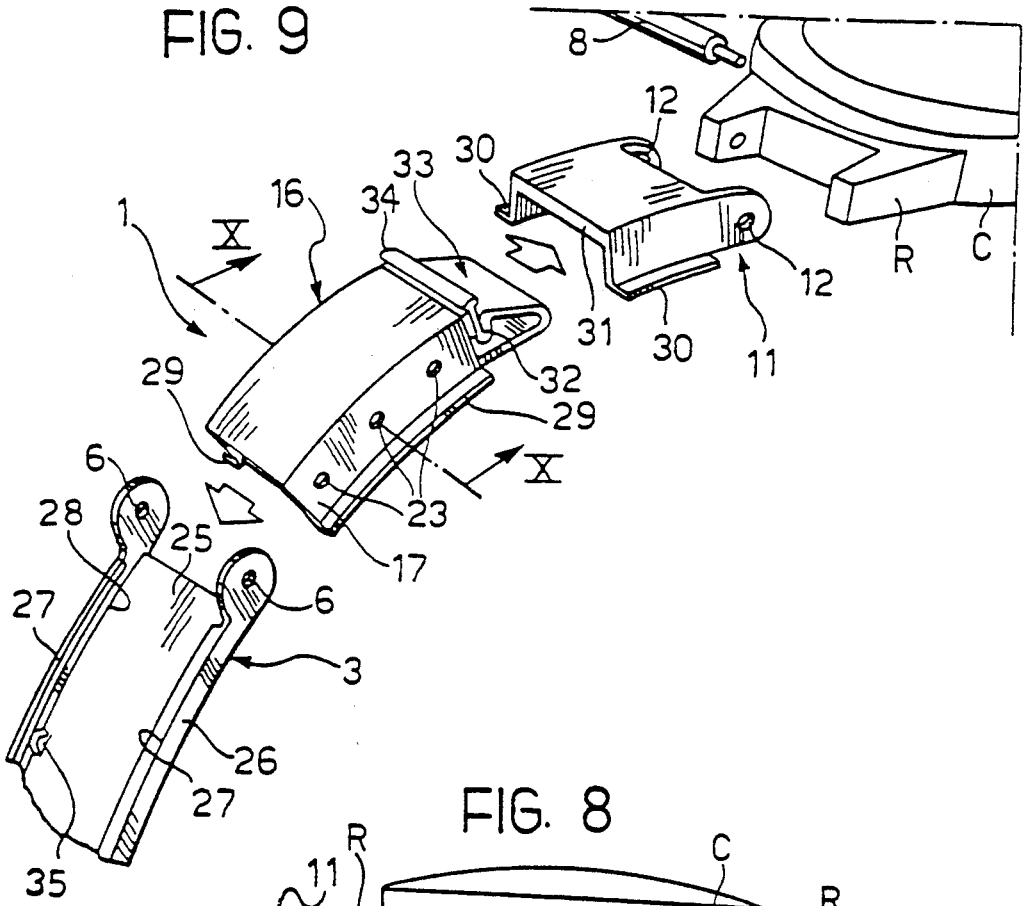
FIG. 9 is a perspective view of the detail indicated by the arrow IX of FIG. 5 on an enlarged scale.
Figure 8:
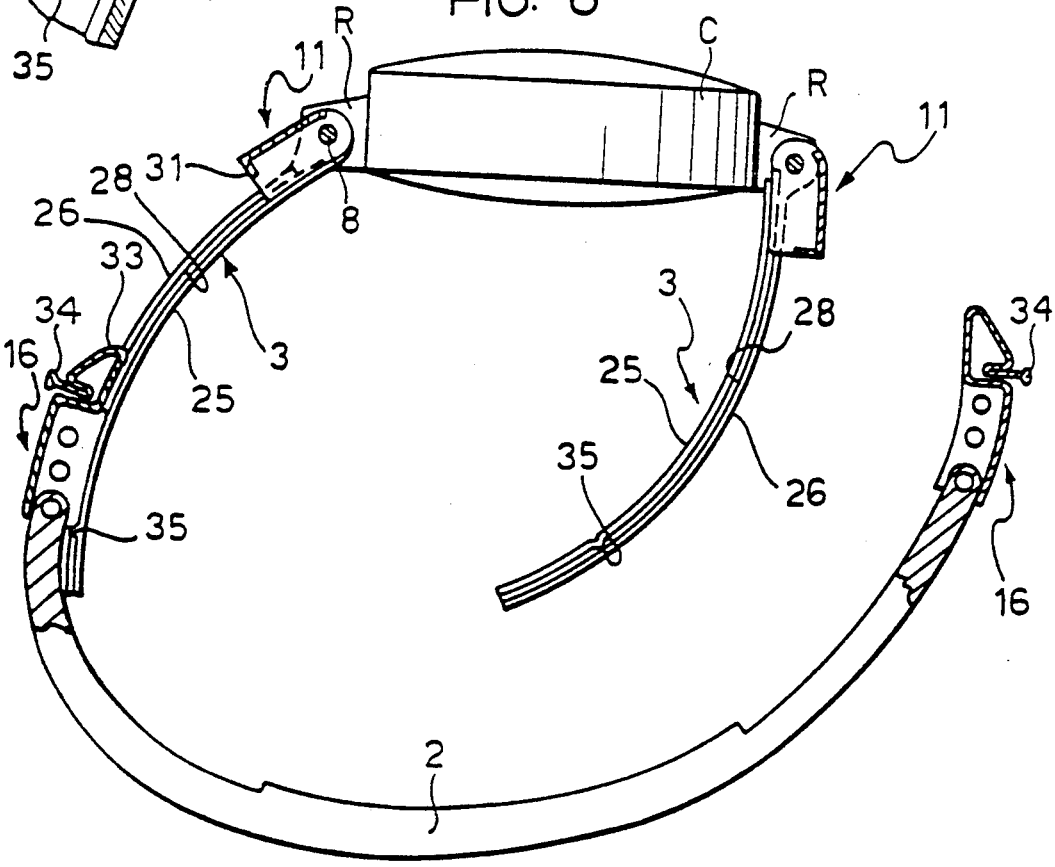
FIG. 8 is a view similar to FIG. 5 with the fastener shown in the partially and completely open positions respectively.
Figure 10:
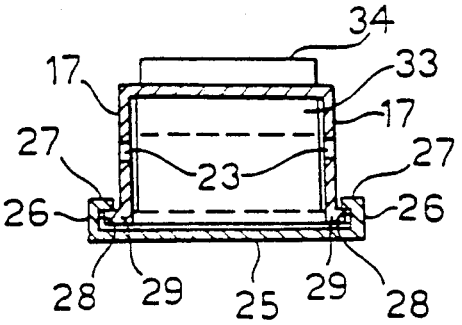
FIG. 10 is a cross-section taken on the line X—X of FIG. 9, on an enlarged scale.

With reference initially to FIGS. 1 and 3, reference 1 generally indicates a fastener for the strap 2 of a wristwatch whose case is indicated C. The fastener 1 includes an arcuate catch element constituted by a metal profile with a channel-shaped cross-section. The catch element 3 has a pair of side flanges 4 formed with longitudinal guide slots 5 which are also arcuate. At one of their ends the flanges have respective holes 6 in which are engaged the ends 7 of a conventional resiliently contractible and extensible pin 8, the central part of which is fitted into a tubular end 2*a* of the strap 2. Adjacent the holes 6, the flanges 4 have respective facing projections 9 which snap-engage in corresponding recesses 10 formed in the sides of an engagement member 11. The engagement member 11 has holes 12 which are aligned with the holes 6 in the flanges 4 and are also engaged by the ends 7 of the pin 8.

The engagement member 11 has a flat front portion 13 with an aperture 14. The side edges of the aperture 14 define a pair of opposing lateral projections 15 whose function will become clear from the description below.

The device 1 also includes a slide element 16 having an arcuate shape corresponding to that of the catch element 3 and which is normally inserted slidably therein.

The slide element 13 has a channel-shaped cross-section with a pair of side flanges 17 facing the flanges 4 of the catch element 3 and located between them. Within the slide element 16 is a pair of engagement members 18 between which is a resilient element 19 which biases the members 18 outwardly in opposite directions. Each engagement member 18 is formed with an engagement tooth 20 projecting from the front end of the slide element 16 for snap-engaging with the corresponding projection 15 of the engagement member 11. The front ends of the teeth 20 are wedge-shaped so as to facilitate their engagement with the corresponding projections 15. The engagement members 18 also have respective push-button portions 21 mounted for sliding in corresponding apertures 22 formed in the flanges 17 of the slide member 16 and projecting through the slots 5 in the catch element 3. Rearwardly of the apertures 22, the flanges 17 have a plurality of holes 23 in which the ends of a resiliently extensible and contractible pin 24 carried by the other end *2b* of the strap 2 can engage. The position in which the end *2b* is fixed to the slider 16 can be varied in dependence on the size of the user's wrist by selection of the hole 23 in which the pin 24 is engaged.

The opposite ends of the strap 2 from the fastener 1 are articulated, in conventional manner, to two opposing appendages R of the watch case C by means of pins similar to the pins 8 and 24.

The fastener 1 operates as follows.

FIGS. 1 and 3 show the condition in which the strap 2 is fastened around the user's wrist. In this position, the slide element 16 is fully advanced relative to the catch element 11 and the teeth 20 are engaged with the corresponding projections 15.

From this configuration, the manual movement of the engagement members 18 towards each other against the action of the resilient biassing member 19 releases the teeth 20 from engagement with the projections 15 and thus enables the slide element 16 to slide backwards relative to the engagement member 11 along the catch element 3. The two push-buttons 21 can thus slide in the guide grooves 5 whilst the slide element 13 moves longitudinally away from the engagement member 11. When the push-buttons 21 reach the outer ends of the guide slots 5, the strap 2 assumes its longest configuration so as to enable the watch to be removed from the user's wrist.

From this position, it is also possible to remove the slide element 16 from the catch element 3, thus separating the ends *2a*, *2b* of the strap 2.

For this purpose, it suffices to move the two engagement members 18 towards each other again by manual action on the respective push-buttons 21 so as to release them from the slots 5.

In order to reposition the device 1 in the starting position, it suffices to repeat the operations described above in reverse.

Figure 4:
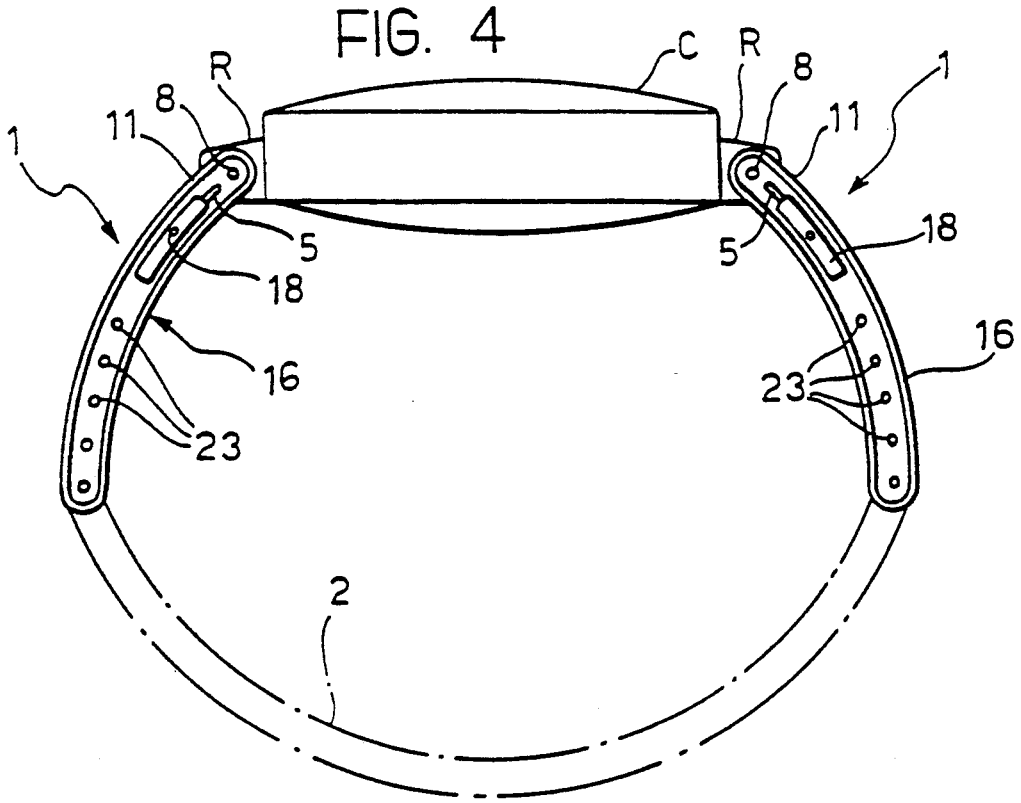
FIG. 4 shows a first variant of FIG. 1.
Figure 2:
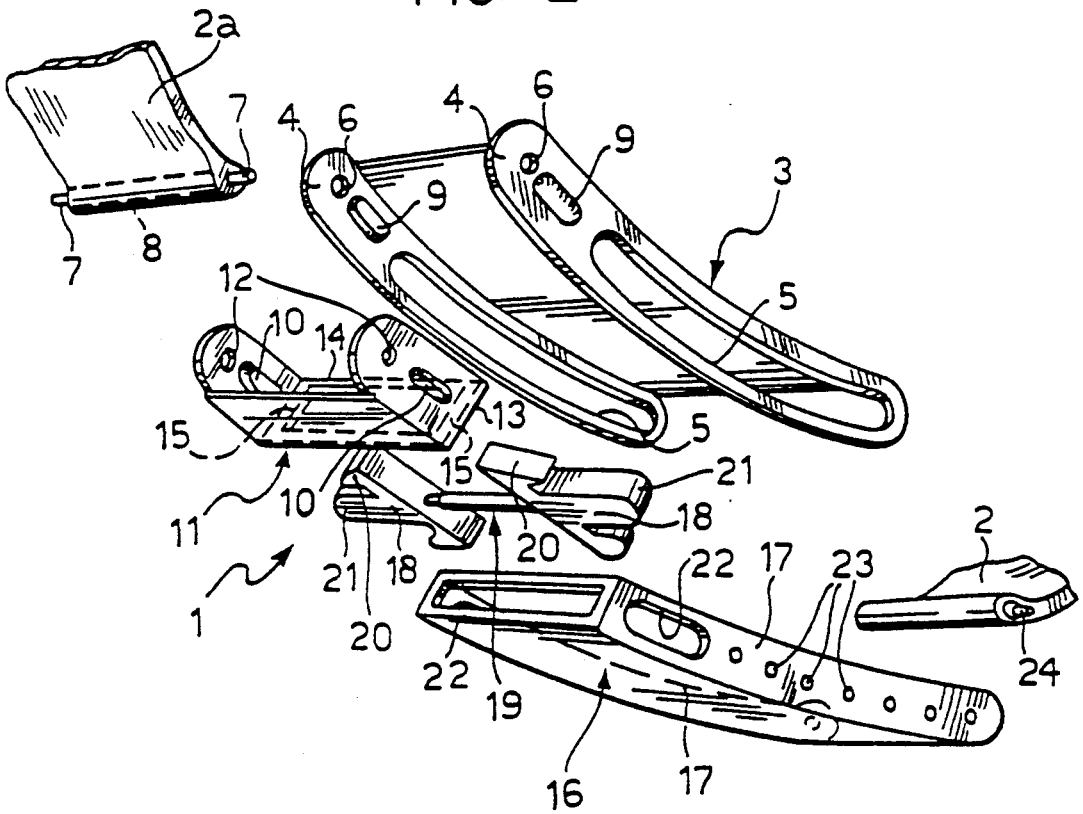
FIG. 2 is a schematic perspective view of part of the fastener.

Instead of a single fastener 1 fitted in the intermediate region of the strap 2, opposite the case C, the invention also provides for the use of a pair of devices 1 fitted to the ends of the strap 2 adjacent the case C, as shown in FIG. 4, in which parts which correspond to those described above are indicated by the same reference numerals.

In this case, the use of two fasteners 1 not only enables the maximum length of the strap 2 to be increased considerably when neither pair of teeth 20 is engaged with the respective engagement projections 15 but also enables the strap to be replaced quickly and easily by the separation of the two slider elements 11 from the respective catch elements 3.

According to another variant, not shown, a single fastener 1 can be used, fitted to only one of the ends of the strap 2 for connection to the watch case C. In that case, the other end of the strap 2 will be connected permanently to the opposite side of the case C by conventional means.

A further variant of the invention is shown in FIGS. 5 to 9: this variant should be considered as the preferred embodiment of the invention.

Its arrangement is similar to that of FIG. 4, with a pair of fasteners according to the invention fitted to the ends of the strap 2 facing the opposing projections R of the case C.

In the following description, the same reference numerals will be used for parts identical to or similar to those described above and only the differences will be described in detail.

In this case each fastener 1 also includes a catch element 3 and an associated end engagement member 11 with respective holes 6.. and 12 for permanent articulation to the corresponding projection R by means of a resiliently contractible and extensible pin 8 and a slide element 16.

The catch element 3 has an arcuate base 25 which projects from the engagement member 11 and the sides of which are defined by longitudinal walls 26 with free edge portions 27, bent towards each other parallel to the base 25 and defining two sliding guides 28. Two outer, side appendages 29 of the slide element 16 and two similar outer side appendages 30 of the end engagement member 11 are slidably engaged in the guides 28. At its opposite end from the case C, the engagement member 11 is formed with a transverse front tab 31 spaced from the base 25 of the catch element 3.

The slide element 16 is formed from a single piece with side walls 17 provided with holes 23 for connection to the corresponding end of the strap 2 and with a bent frontal part which constitutes the latch member which cooperates with the engagement tab 31. The latch member is constituted by a transverse recess 32 defined on one side by a resilient bent appendage 33 and on the opposite side by an upwardly-projecting push appendage 34.

At its opposite end from the engagement member 11, the base 25 of the catch element 3 has a projection 35 which acts as a brake and may be constituted by a simple projection (as in the embodiment illustrated) or by a rib extending transversely between the two sliding guides 28.

In the configuration shown in FIGS. 5 to 7, the two fasteners 1 are both arranged in the condition in which the strap 2 is shortest. In this condition, the engagement tabs 31 are engaged in the complementary recesses 32 of the respective slide elements 16.

In order to enlarge the loop formed by the strap 2 and the case C, it is necessary, as in the previous cases, to release one or other or both of the slider elements 16 from the respective engagement members 11. In order to do this, it suffices to push the respective push appendage 34 downwardly, resiliently deforming the appendage 33 until the recess 32 is released from the engagement tab 31. This enables the slide element 16 to be moved along the sliding guides 28 to the fully retracted condition shown on the left in FIG. 8. The slide element 16 is stopped in this position by the friction of the projection 35 with the back face of the region of the strap 2 which is fixed to the slide element 16. In order to separate the slide element 16 completely from the catch element 3, for example to enable the strap 2 to be replaced, it suffices for it to be pulled sufficiently to overcome the frictional interference with the projection 35. The separated condition is shown on the right in FIG. 8.

In order to return to the shortest configuration of the strap 2, shown in FIGS. 5 to 7, the operations described above must obviously be performed in reverse. The or each slide element 16 engages the respective end engagement member 11 automatically as a result of the resilient deformation of the appendage 33 as it advances beneath the engagement tab 31 until the tab snap-engages in the respective recess 32.

Naturally, further embodiments can be envisaged within the scope of the invention. Thus, for example, the unitary embodiment of the slide element 16 could also be used for a lateral engagement system similar to that described with reference to FIGS. 1 to 4.

The embodiment shown in FIGS. 11 and 12 differs from that described with reference to FIGS. 5 to 9 in that the engagement member is omitted, or rather, is formed integrally with the catch element 3, so that each fastener 1 is constituted, in practice, by only two basic components: the catch element 3 and the slide element 16.

In this case the catch element 3, which is articulated to the projection R of the watch case C by means of the pin 8, has an upper wall 36 parallel to its base wall 25 and two opposed slot-like apertures 37 are formed in its side walls 26 adjacent the pin 8. A further pair of apertures 38, identical to the apertures 37, are formed near the opposite end of the catch element 3.

The slide element 16 carries a pair of opposed lateral push-buttons 39 which are similar to the push-buttons 21 of the embodiment of FIGS. 1 to 4 and can be pushed towards each other, against the action of a resilient pin 40.

Figure 12:
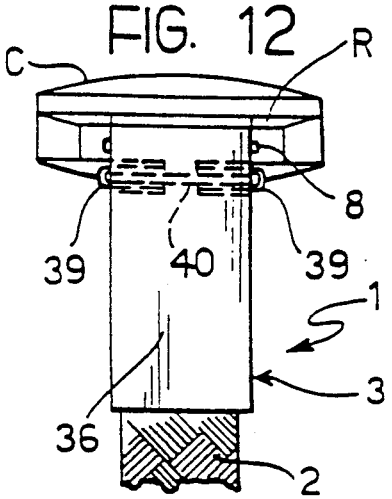
FIG. 12 is an elevational view taken on the arrow XII of FIG. 11.
Figure 11:
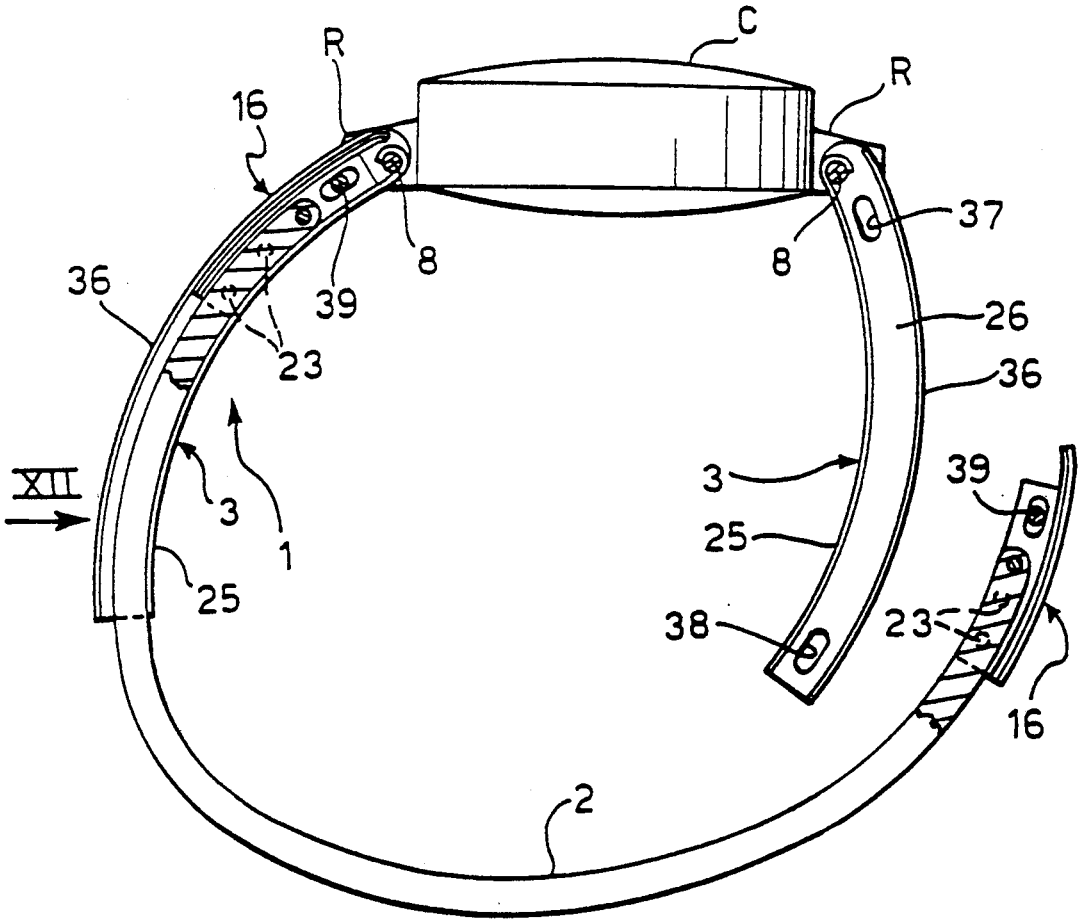
FIG. 11 is a view similar to FIG. 8 of a third variant of the invention.

When the slider 16 is in the advanced position shown on the left in FIG. 11 and in FIG. 12, which corresponds to the shortest condition of the strap 2, the two push-buttons 39 are engaged in the respective apertures 37 in the catch element 3.

In order to enlarge the loop formed by the strap 2 and the case C, it is necessary to push the two push-buttons 39 towards each other manually until they are released from the apertures 37. This enables the slider element 16 to be moved along the catch element 3, between its walls 25 and 36, to the fully retracted condition in which the two push-buttons 39 snap-engage in the apertures 38. In order to separate the slider element 16 completely from the catch element 3, it suffices to release the two push-buttons 39 from the apertures 38. The separated condition is shown on the right in FIG. 11.

We claim:

1. A fastener for connecting a wristwatch strap having two ends to opposite sides of a watch case comprising two arcuate catch elements articulated to opposite sides of the watch case, each catch element being provided with guide means extending longitudinally of the strap and two end engagement members articulated to opposite sides of the watch case together with a respective catch element, and two slide elements connected to opposite ends of the strap, each slide element being provided with a latch member complementary to a respective end engagement member and being slidable along a respective guide means between an advance position in which the strap is shortest and in which the latch members engage respective engagement members and a retracted position in which the strap is longest, release means being provided for releasing each latch member from a respective engagement member when each slide element is in the advanced position and for enabling each slide element to be released from a respective catch element in the retracted position to unfasten the strap.

2. A device according to claim 1, characterised in that each catch element (3) comprises a base (25) which projects from the end engagement member (11) and is provided with raised side walls (26) with free edge portions (27) which are bent inwardly of the base (25) and define respective longitudinal sliding guides (28), and in that each slide element (16) has two outer, side appendages (29) which are slidably engaged with the sliding guides (28) of the respective catch element (3).

3. A device according to claim 2, characterised in that the engagement member is integral with the catch element (3) and includes two pairs of opposed apertures (37, 38) formed near the ends of its side walls (26), and in that the latch member of the slide element (16) is constituted by a pair of opposed push-buttons (39) which can be moved towards each other against the action of resilient biassing means (40) and can be engaged in one or other of the pairs of apertures (37, 38) of the catch element (3) when the slide element (16) is in the advanced position or in the retracted position respectively.

4. A device according to claim 1, characterised in that the end engagement member (11) is formed with a transverse tab (31) situated above the base (25) of the catch element (3), and in that the latch element is defined by a complementary recess (32) formed by a resilient, integral front appendage (33) of the slider element (16) which is resiliently deformable by means of a push member (34).

5. A device according to claim 3, characterised in that the base (25) of the catch element (3) has a projection (35) at its opposite end from the end engagement member (11) for frictional interference with the back of the strap (2) when the latter is in the retracted position.

6. A device according to claim 1, characterised in that each catch element (3) has two longitudinal lateral guide slots (5) and each slider element (16) has a pair of opposed lateral engagement members (18) mounted for sliding in the guide slots (5) and movable towards each other against the action of resilient biassing means (19), the engagement members (18) being provided with respective latch teeth (20) for cooperating with corresponding lateral fixing projections (15) of the end engagement member (11).

7. A device according to claim 6, characterised in that the engagement members (18) have respective operating push-button portions (21) projecting through the guide slots (5) in the catch element (3).

8. A device according to claim 6, characterised in that the latch teeth (20) have wedge-shaped front ends.

* * * * *